US011564471B1

(12) United States Patent
Landau et al.

(10) Patent No.: US 11,564,471 B1
(45) Date of Patent: Jan. 31, 2023

(54) NAIL CLIPPING SCISSORS

(71) Applicants: Abraham Landau, Lakewood, NJ (US); Charles Lord, Scottsdale, AZ (US)

(72) Inventors: Abraham Landau, Lakewood, NJ (US); Charles Lord, Scottsdale, AZ (US)

( * ) Notice: Subject to any disclaimer, the term of this patent is extended or adjusted under 35 U.S.C. 154(b) by 0 days.

(21) Appl. No.: 17/495,405

(22) Filed: Oct. 6, 2021

(51) Int. Cl.
*A45D 29/02* (2006.01)

(52) U.S. Cl.
CPC ..... *A45D 29/02* (2013.01)

(58) Field of Classification Search
CPC . A45D 29/02; A45D 29/023; A45D 2029/026
USPC ..... 30/26–29, 341, 266, 268–270
See application file for complete search history.

(56) References Cited

U.S. PATENT DOCUMENTS 573,075 A * 12/1896 Dohnal ..... B26B 13/28 30/269
753,919 A * 3/1904 Rowe ..... B26B 13/00 30/256
843,388 A * 2/1907 Wooster ..... A45D 29/02 30/28
846,565 A * 3/1907 Havell ..... A45D 29/02 30/28
938,630 A * 11/1909 Baur ..... B26B 13/28 30/266
1,066,839 A * 7/1913 Pettibone ..... A45D 29/02 30/28
1,363,164 A * 12/1920 Oesterwitz ..... A45D 29/02 30/28
1,533,479 A * 4/1925 Stitt ..... A01G 3/065 30/226
2,203,541 A * 6/1940 Muserlian ..... B26B 13/285 30/254
2,361,387 A * 10/1944 Edwards ..... B26B 13/06 132/75.5
2,854,005 A * 9/1958 Vido ..... A61B 17/3201 606/174
3,609,863 A * 10/1971 Woodward ..... B26B 13/285 30/266
3,832,771 A * 9/1974 Morgan ..... A45D 29/02 30/28
4,644,644 A * 2/1987 Elsholz ..... A45D 29/02 132/75.5
5,357,676 A * 10/1994 Bannett ..... A45D 29/02 30/26
5,791,049 A * 8/1998 Dolev ..... A45D 29/02 132/75.5

(Continued)

*Primary Examiner* — Clark F Dexter
(74) *Attorney, Agent, or Firm* — Culhane Meadows, PLLC; Robert Klinger

(57) ABSTRACT

A nail clipping device with scissor-like cutting edges and a positively engaging pin to trim a nail. In one example, a user interacts with the nail clipper to trim a nail by applying pressure to an operating lever element resulting in the movement of the cutting edges sliding against and past each other to trim a nail in a manner similar to using scissors. In this process, the positively engaging pin applies a longitudinal force to an intermediate lever resulting in an upper cutting edge being urged against a lower cutting edge creating a constant contact point between the cutting edges. This results in a clean and easy cut while containing and controlling the trimmed nails.

14 Claims, 6 Drawing Sheets

(56) References Cited

U.S. PATENT DOCUMENTS

| | | | | |
|---|---|---|---|---|
| 5,813,417 | A * | 9/1998 | Rudolph | B26B 13/24 132/200 |
| 6,438,845 | B1 * | 8/2002 | Jung | A45D 29/02 30/28 |
| 7,530,170 | B2 * | 5/2009 | Shackelford | A45D 29/02 132/75.5 |
| 10,869,530 | B2 * | 12/2020 | Middelkoop | A01K 17/00 |
| 2003/0101596 | A1 * | 6/2003 | Deville | B25G 3/26 30/341 |
| 2005/0005456 | A1 * | 1/2005 | Wang et al. | B26B 13/12 30/232 |
| 2007/0124942 | A1 * | 6/2007 | Nenadich et al. | B26B 13/285 30/266 |
| 2013/0327348 | A1 * | 12/2013 | Ashur | B26B 29/04 132/73.6 |

* cited by examiner

NAIL CLIPPING SCISSORS

TECHNICAL FIELD

The present disclosure generally relates to a nail clipping device for enhancing the clipping of nails.

BACKGROUND

Conventional nail clipper devices are well known in the art and regularly used by many people. These nail clippers typically comprise of a sharpened upper member and a sharpened lower member to apply a dispersed cutting force across the nail to be clipped. These sharpened members do not overlap each other and merely touch at the sharpened edges.

BRIEF DESCRIPTION OF THE DRAWINGS

In the drawings, which are not necessarily drawn to scale, like numerals may describe similar components in different views. Like numerals having different letter suffixes may represent different instances of similar components. Some examples are illustrated by way of example, and not limitation, in the figures of the accompanying drawings in which.

DETAILED DESCRIPTION

Examples described herein include a nail clipping device with scissor-like cutting edges and a positively engaging pin. In one example, a user interacts with the nail clipper to trim a nail by applying pressure to an operating lever element resulting in the movement of the cutting edges sliding against and past each other to trim a nail in a manner similar to using scissors. In this process, the positively engaging pin applies a longitudinal force to an intermediate lever resulting in an upper cutting edge being urged against a lower cutting edge creating a constant contact point between the cutting edges. This results in a clean and easy cut while containing and controlling the trimmed nails.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, and components have been described at a relatively high-level, without detail, in order to avoid unnecessarily obscuring aspects of the present teachings.

The term "coupled" as used herein refers to any logical or physical element that is imparted to another coupled element. Unless described otherwise, coupled elements or devices are not necessarily directly connected to one another and may be separated by intermediate components or elements.

Also, to the extent used herein, any directional term, such as front, rear, inwards, outwards, towards, left, right, lateral, longitudinal, up, down, upper, lower, top, bottom and side, are used by way of example only, and are not limiting as to direction or orientation of any optic or component of an optic constructed as otherwise described herein.

Reference now is made in detail to the examples illustrated in the accompanying drawings and discussed below.

Figure 1:
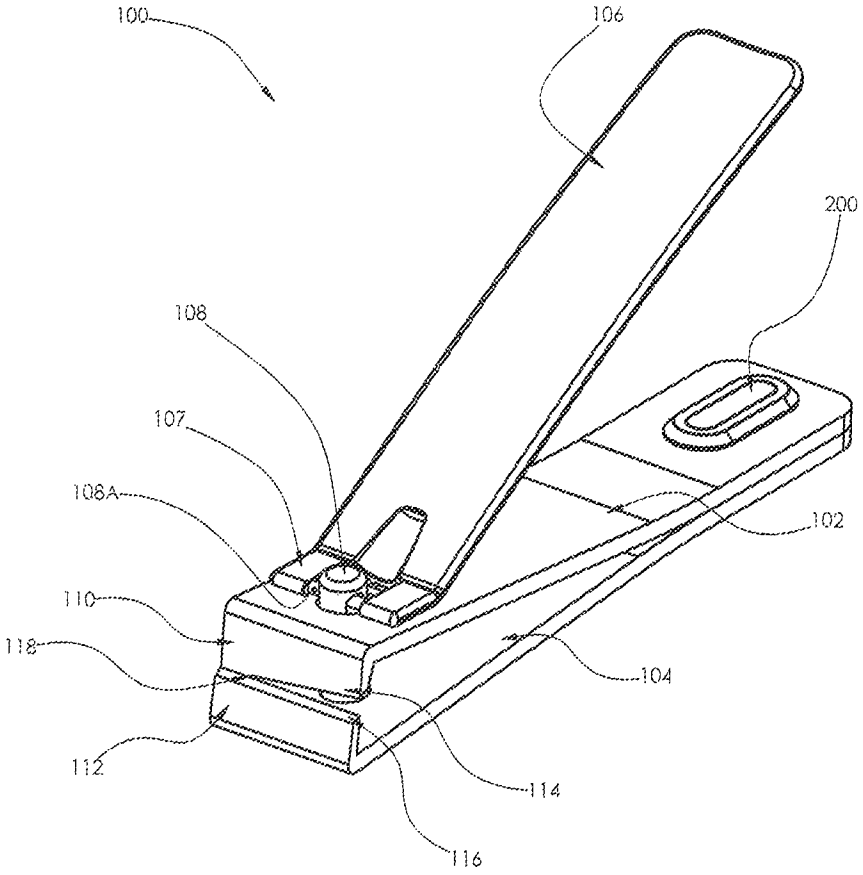
FIG. 1 illustrates a perspective view of a nail clipper with an operating lever element in an operating position.

FIG. 1 is a perspective view of a nail clipper 100 with an intermediate lever element 102 coupled to a base lever element 104 via a post 108 and an obround positively engaging pin 200, and an operating lever element 106 pivotably coupled to the post 108 via a horizontal pin 108A. The operating lever element 106 includes a fulcrum 107 which is coupled to the horizontal pin 108A for the operation of the nail clipper 100. The operating lever element 106 is in the operation position in this configuration. The post 108 extends through aligned holes in the intermediate lever element 102 and the base lever element 104. The intermediate lever element 102 is coupled above the base lever element 104 via the positively engaging pin 200 at one end and, the intermediate lever element 102 is coupled above and spaced from the base lever element 104 by the post 108 at the other end. The intermediate lever element 102 includes an upper face 110 that extends towards a lower face 112 of the base lever element 104. The upper face 110 includes an upper cutting edge 114 and the lower face 112 includes a lower cutting edge 116. The upper cutting edge 114 is in contact with the lower cutting edge 116 at a contact point 118. The cutting edges 114 and 116 are in a nonparallel alignment for the scissor-like operation of the nail clipper device 100.

Figure 2:
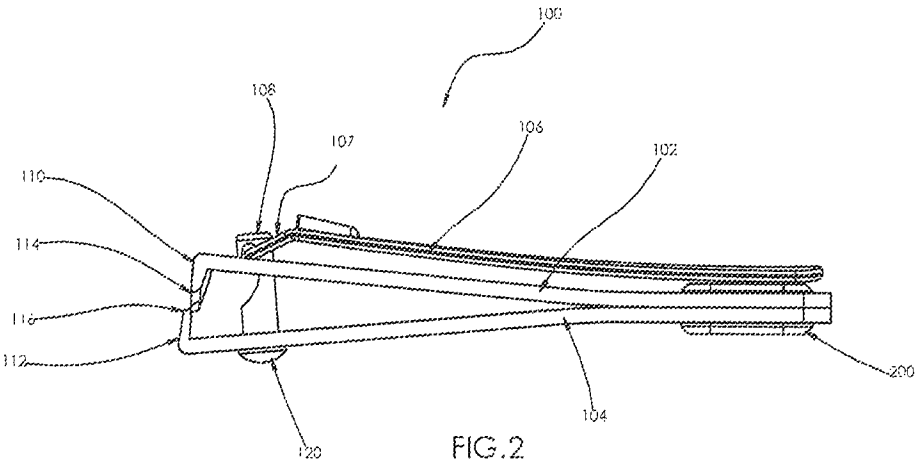
FIG. 2 illustrates a side view of the nail clipper with the operating lever element in a storage position.

FIG. 2 is a side view of the nail clipper 100 with the operating lever element 106 rotated into a storage position where the operating lever element 106 rests on the intermediate lever element 102. A bearing 120, which is rotatably coupled to the post 108, and the horizontal pin 108A allow the operating lever element 106 to be moved in this manner. The operating lever element 106 is capable of being rotated about a vertical axis, for example, the vertical axis of the post 108, and this also causes the post 108 to rotate about its vertical axis by means of the bearing 120. The operating lever element 106 can also be rotated about the horizontal axis of the horizontal pin 108A as it is moved from the positions of FIG. 1 to FIG. 2. Further, the upper cutting edge 114 is disposed behind the lower cutting edge 116 in this configuration. This allows for the cutting edges 114 and 116 to engage and slide past one another for the scissor-like operation of the nail clipper device 100 while retaining the trimmed nail.

Figure 3:
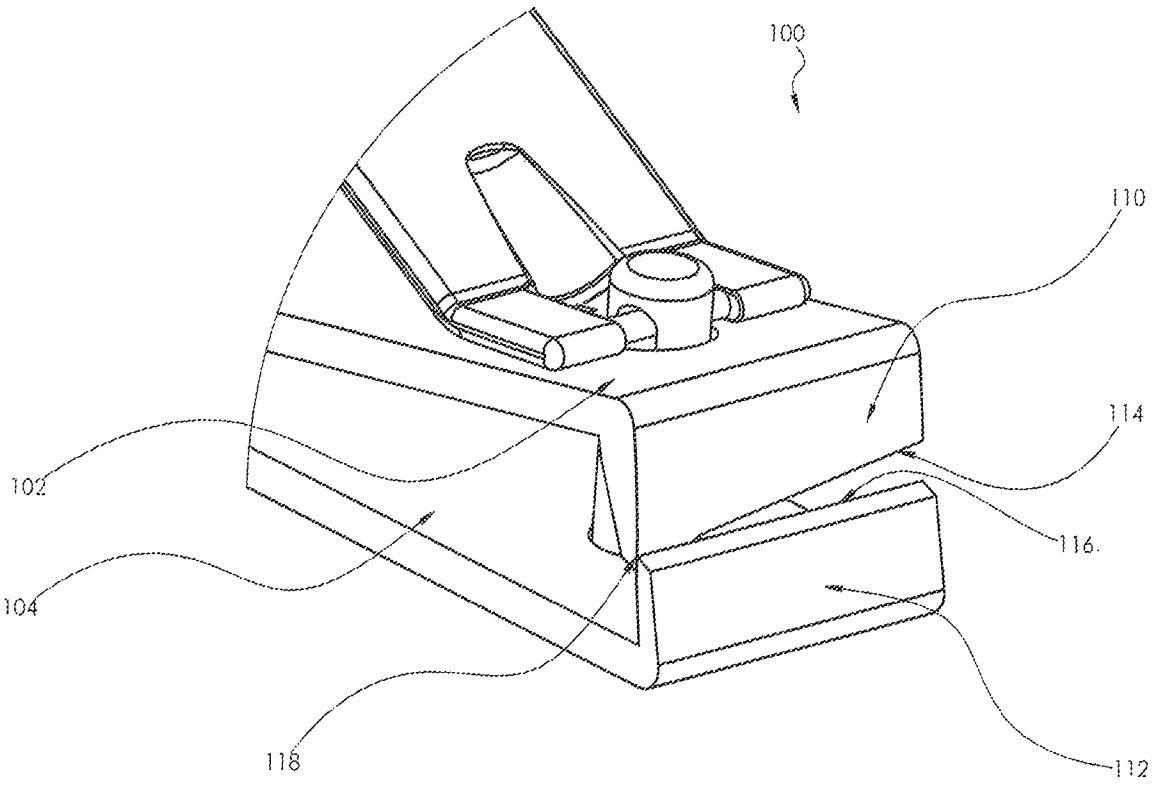
FIG. 3 illustrates an enlarged perspective view of the cutting edges of the nail clipper in FIG. 1 when the intermediate and base lever element are in a resting position.
Figure 4:
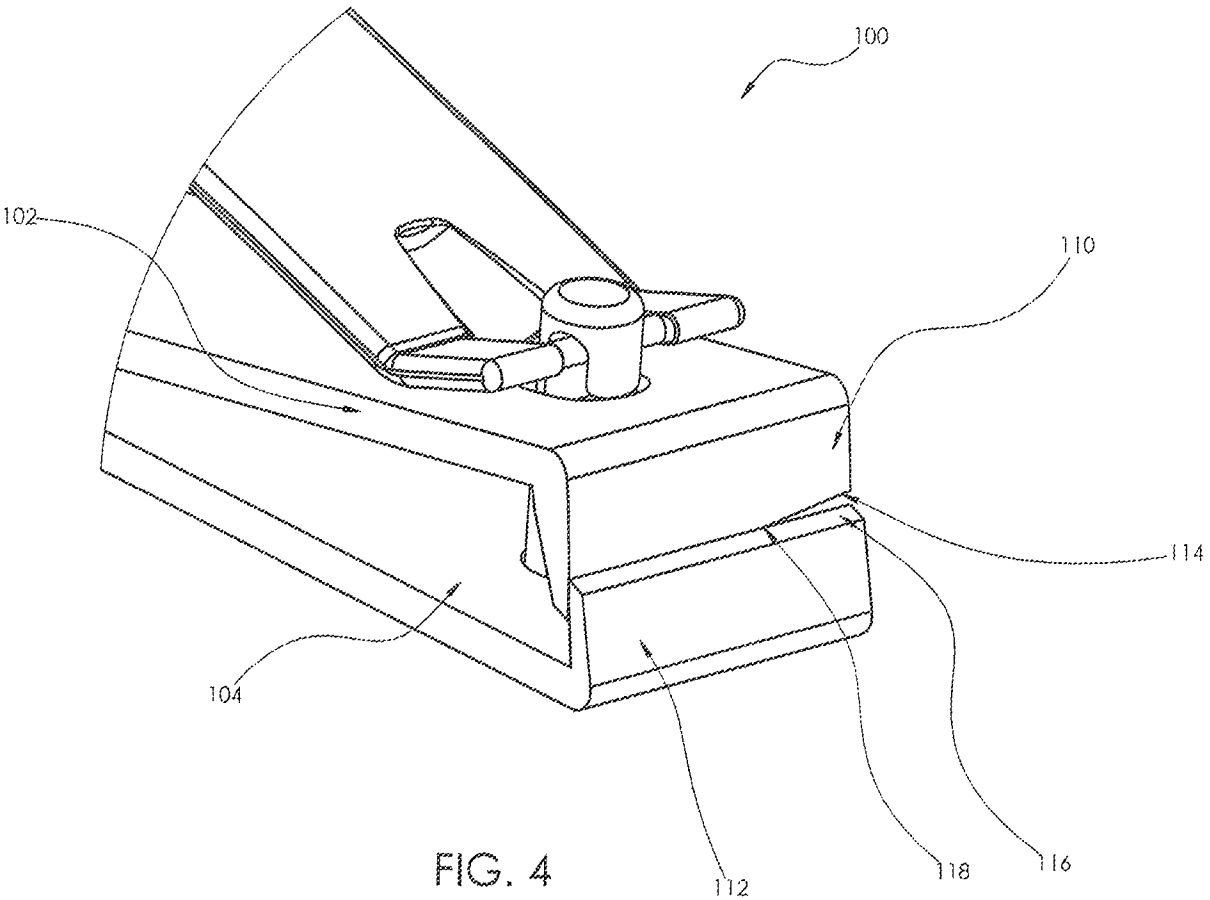
FIG. 4 illustrates an enlarged perspective view of the cutting edges of the nail clipper in FIG. 1 when the intermediate and base lever element have been moved closer together.

FIG. 3 is an enlarged view of the faces 110 and 112 of the nail clipper in a resting position. In this embodiment, at rest the upper cutting edge 114 and the lower cutting edge 116 are in contact with each other at contact point 118 on the nearside of the nail clipper 100. This allows spacing between the cutting edges 114 and 116 to insert a nail between the cutting edges 114 and 116. As pressure is applied to the operating lever element 106 while in the operation position seen in FIG. 1, the contact point 118 moves laterally along the cutting edges 114 and 116 to a point further down the cutting edge as seen in FIG. 4. The movement of the contact point 118 cuts through the nail disposed between the cutting edges 114 and 116 in the same manner as a pair of scissors.

Figure 5:
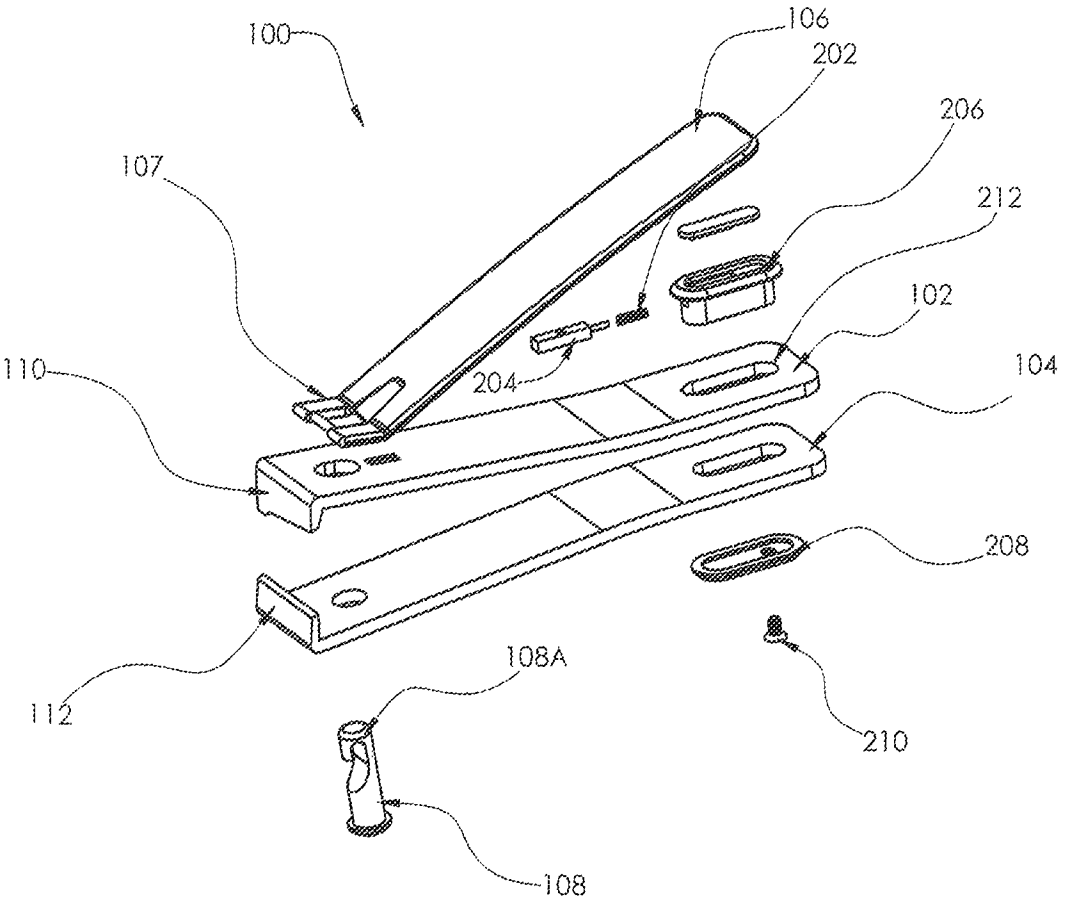
FIG. 5 illustrates an exploded view of the components including a positively engaging pin of the nail clipper in FIG. 1.

FIG. 5 is an exploded view including the obround positively engaging pin 200 including an upper casing 206, a lower casing 208, a pressure bar 204, and a spring 202. The spring 202 creates a longitudinal bias force between an inner recess 207 of the upper casing 206 and the pressure bar 204 which abuts the intermediate lever element 102. The upper casing 206 and the lower casing 208 are coupled together by a screw 210 to form the obround positively engaging pin 200. The obround positively engaging pin 200 extends through an obround hole 212 in the intermediate lever element 102 and through an aligned obround hole 214 in the base lever element 104 to couple the lever elements 102 and 104. Each of the obround holes 212 and 214 have a length comprising a longitudinal dimension extending longitudinally along the longitudinally extending lever elements 102 and 104. The length of the obround hole 212 is slightly longer than the length of hole 214 and is configured to allow the lever element 102 to slide past the lever element 104 during nail cutting with compression or extension of the spring 202, and also prevents lateral movements between the lever elements 102 and 104. This spring 202 creates a constant contact point 118 between the two cutting edges 114 and 116 for optimal performance of the nail clipper 100.

Figure 6:
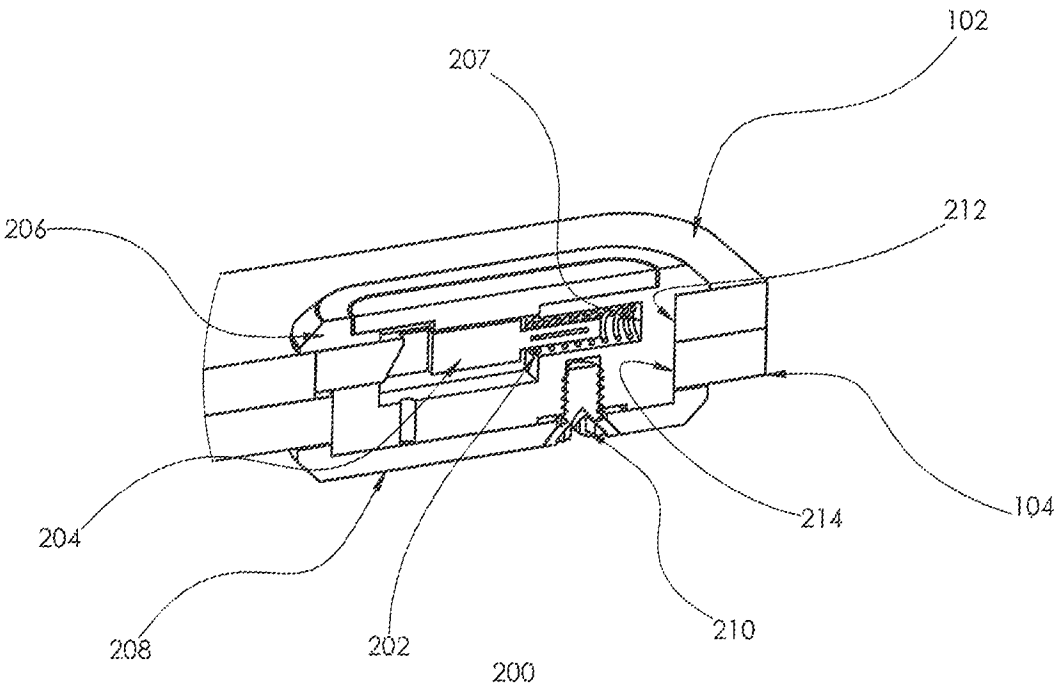
FIG. 6 illustrates the cross-sectional view of the nail clipper with emphasis on the positively engaging pin of the nail clipper.

FIG. 6 is a cross-sectional perspective view of the oblong positively engaging pin 200 when installed in the nail clipper 100. The spring 202 leverages off the inner recess 207 and applies a longitudinal bias force on the longitudinally extending pressure bar 204 which in turn abuts the intermediate lever element 102. The spring 202 and the pressure bar 204 establish the position of the intermediate lever element 102 to create a constant force at contact point 118 between the two cutting edges 114 and 116 for optimal performance of the nail clipper 100.

The operation of the nail clipper device 100 will now be described with specific reference to the cutting configuration of the nail clipper device and the oblong positively engaging pin 200. A user of the nail clipper device 100 will grasp the nail clipper 100 between fingers and/or a thumb. The user applies downward pressure to the operating lever element 106 and upward pressure to the base lever element 104, therefore moving the cutting edges 114 and 116 toward and past each other while a fingernail is positioned therebetween.

The upper face 110 and lower face 112 are thus moved towards each other, the movement of the faces 110 and 112 moving the cutting edges 114 and 116 toward each other and resulting in the movement of the contact point 118 laterally along the cutting edges 114 and 116 due to the unparallel orientation of the cutting edges 114 and 116. This scissor-like operation of the cutting edges 114 and 116 will continue across the cutting edges 114 and 116 until the cutting edges 114 and 116 are in an overlapping arrangement and cooperation. During this cutting operation, the spring 202 and the pressure bar 204 of the oblong positively engaging pin 200 provides constant pressure between the upper cutting edge 114 and the lower cutting edge 116. The larger length of obround opening 212 for the positively engaging pin 200 allows longitudinal movement of the intermediate lever element 102 with respect to the base lever element 104. The spring 202 and the pressure bar 204 generate and ensure constant pressure between the cutting edges 114 and 116, while eliminating lateral movement between the intermediate lever element 102 and the base lever element 104. This results in a smooth operation of the nail clipper device 100. Further, the oblong positively engaging pin 200 with scissor-like configuration of the cutting edges eliminates the need for precise manufacturing due the oblong positively engaging pin 200 correcting any deviation in specified dimensions of the intermediate and base lever elements 102 and 104. Therefore, the oblong positively engaging pin 200 reduces the cost of production and ensures a successful product.

The above-described operation of the nail clipper device 100 enables the nail clipper device 100 to cut most finger and toenails. For example, and in no way limiting of this disclosure, nails can be easily cut by the nail clipper device 100 as the scissor like cutting configuration provides a smooth and even cut to produce a nice finish as compared to a traditional nail clipper cutting blade configuration. The scissor-like configuration further results in less pressure required to cut through a nail while producing a pleasant sounding cut over the irritating snap of the nail when compared to a traditional clipper cutting blade configuration. Further, the nail clipper device 100 prevents the uncontrolled displacement of the cut fingernail. The scissor-like cutting operation controls the cut nail so it is not propelled away in a random direction from the remaining nail. The cut nail is then able to be retained close to the finger. Moreover, due to the cutting edges 114 and 116 sliding past one another, the edges will remain sharper than the edges of a clipper which close on one another in the traditional configuration.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

While the foregoing has described what are considered to be the best mode and other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A nail clipper comprising:

a first member and a second member, wherein each of the members extend longitudinally and include a respective face, wherein each of the faces extend laterally and include a respective cutting edge, and the faces are configured to slide past and against one another when the first and second members are moved toward each other in a cutting movement; and a positively engaging pin coupling the first member to the second member, wherein the positively engaging pin:

inhibits lateral movement between one of the members with respect to the other member; and generates a linear force longitudinally to urge the cutting edges against one another by causing one of the members to slide longitudinally with respect to the other member so that the cutting edge of the one member is urged against the cutting edge of the other member when they slide past and against one another.

2. The nail clipper of claim 1, wherein one of the cutting edges is not in parallel alignment with the other cutting edge.

3. The nail clipper of claim 1, wherein the linear force is perpendicular to the cutting edges.

4. The nail clipper of claim 1, wherein the positively engaging pin is obround.

5. The nail clipper of claim 4, wherein the positively engaging pin comprises a spring coupled to the first member, the spring generating the linear force to urge the cutting edge of the first member against the cutting edge of the second member.

6. The nail clipper of claim 5, wherein the positively engaging pin comprises an element coupled to the spring configured to distribute force from the spring to the first member.

7. The nail clipper of claim 1, further comprising an operating lever rotatably coupled to both the first member and the second member via a post, the operating lever configured to urge the first member toward the second member.

8. A method of trimming a nail using nail clippers comprising a first member and a second member wherein each of the members extend longitudinally and include a respective face, wherein each of the faces extend laterally and include a respective cutting edge, and the faces are configured to slide past and against one another when the members are moved toward each other in a cutting movement, and a positively engaging pin coupling the first member to the second member, wherein the positively engaging pin inhibits lateral movement between one of the members with respect to the other member, and generates a linear force longitudinally to urge the cutting edges against one another by causing one of the members to slide longitudinally with respect to the other member so that the cutting edge of the one member will urged against the cutting edge of the other member when they slide past and against one another, the method comprising:

disposing the nail between the cutting edges; and moving the first and second members toward each other in the cutting movement such that the cutting edges slide past and against one another to result in the cutting edges cutting through the nail.

9. The method of claim 8, wherein one of the cutting edges is not in parallel alignment with the other cutting edge.

10. The method of claim 9, wherein the positively engaging pin is obround.

11. The method of claim 8, wherein the linear force is perpendicular to the cutting edges.

12. The method of claim 8, wherein the positively engaging pin comprises a spring coupled to the first member, the spring generating the linear force to urge the cutting edge of the first member against the cutting edge of the second member.

13. The method of claim 12, wherein the positively engaging pin comprises an element coupled to the spring distributing force from the spring to the first members.

14. The method of claim 8, wherein the nail clipper further comprises an operating lever rotatably coupled to both the first member and the second member via a post, the operating lever urging the first member toward the second member.

* * * * *